United States Patent [19]

Pitha

[11] Patent Number: 4,478,208

[45] Date of Patent: Oct. 23, 1984

[54] FIREPLACE CONSTRUCTION

[76] Inventor: Jay R. Pitha, R.D. #3, Box 211, Washington, N.J. 07882

[21] Appl. No.: 572,841

[22] Filed: Jan. 23, 1984

Related U.S. Application Data

[63] Continuation-in-part of Ser. No. 359,058, Mar. 17, 1982.

[51] Int. Cl.[3] ..... F24B 7/00

[52] U.S. Cl. ..... 126/121; 126/120; 52/218; 52/219; 110/336

[58] Field of Search ..... 52/218, 219, 610; 126/151, 120, 121; 110/336, 338; 237/51

[56] References Cited

U.S. PATENT DOCUMENTS

| | | | |
|---|---|---|---|
| 933,774 | 9/1909 | Mascheno | 52/219 |
| 1,170,936 | 2/1916 | Royse | 52/610 |
| 1,297,652 | 3/1918 | Brunner | 52/218 |
| 3,201,907 | 8/1965 | Henderson | 52/219 |
| 4,232,652 | 11/1980 | Serwatowski | 126/120 |
| 4,384,566 | 5/1983 | Smith | 126/120 |

FOREIGN PATENT DOCUMENTS

| | | | |
|---|---|---|---|
| 456957 | 4/1950 | Italy | 52/610 |
| 510943 | 1/1955 | Italy | 52/219 |
| 73648 | 6/1953 | Netherlands | 52/219 |

*Primary Examiner*—Samuel Scott
*Assistant Examiner*—Helen A. Odar
*Attorney, Agent, or Firm*—Hopgood, Calimafde, Kalil, Blaustein & Judlowe

[57] ABSTRACT

The invention contemplates a fireplace comprising a stacked plurality of courses of modular prismatic blocks laid upon a base to define a firebox region of opposed side walls and a rear wall contiguous thereto. In one embodiment the blocks are characterized by at least one horizontal surface having external horizontal channel formations and by limited vertically extending end passages such that one or more vertically serpentine continuous air-flow ducts are established through successive horizontal channels in the stacked plurality of courses of the walls. Above the firebox region, and surrounding an associated chimney region, the wall-block courses continue, providing extension of the air-flow duct system into additional heat-exchanging relation with the chimney. The chimney-flue system also relies on modular blocks with vertical flue passages which register from one to the next course, the arrangement being such as (1) to provide relatively large flue-surface area for extraction of flue-gas heat and (2) to cause plural cycles of horizontal undulation of the vertical flow of exhausted flue gases, in their upward passage through the chimney.

12 Claims, 43 Drawing Figures

FIG. 25.
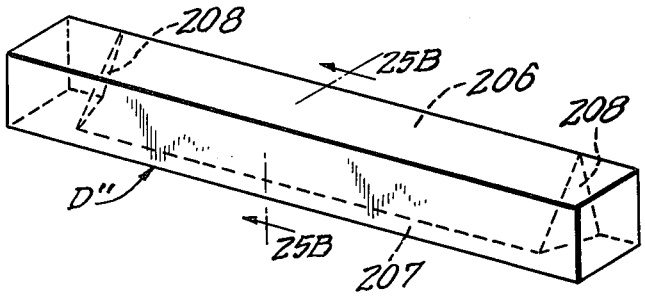
FIG. 24.
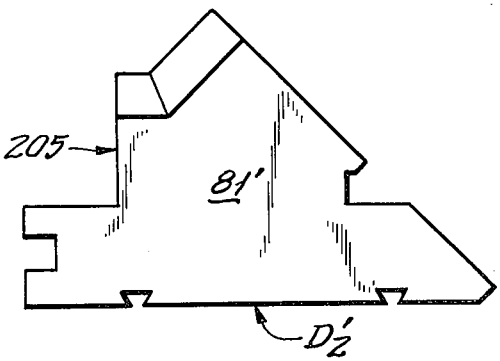
FIG. 25A.
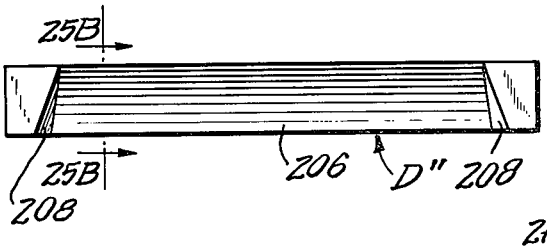
FIG. 25B.
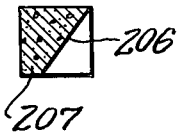
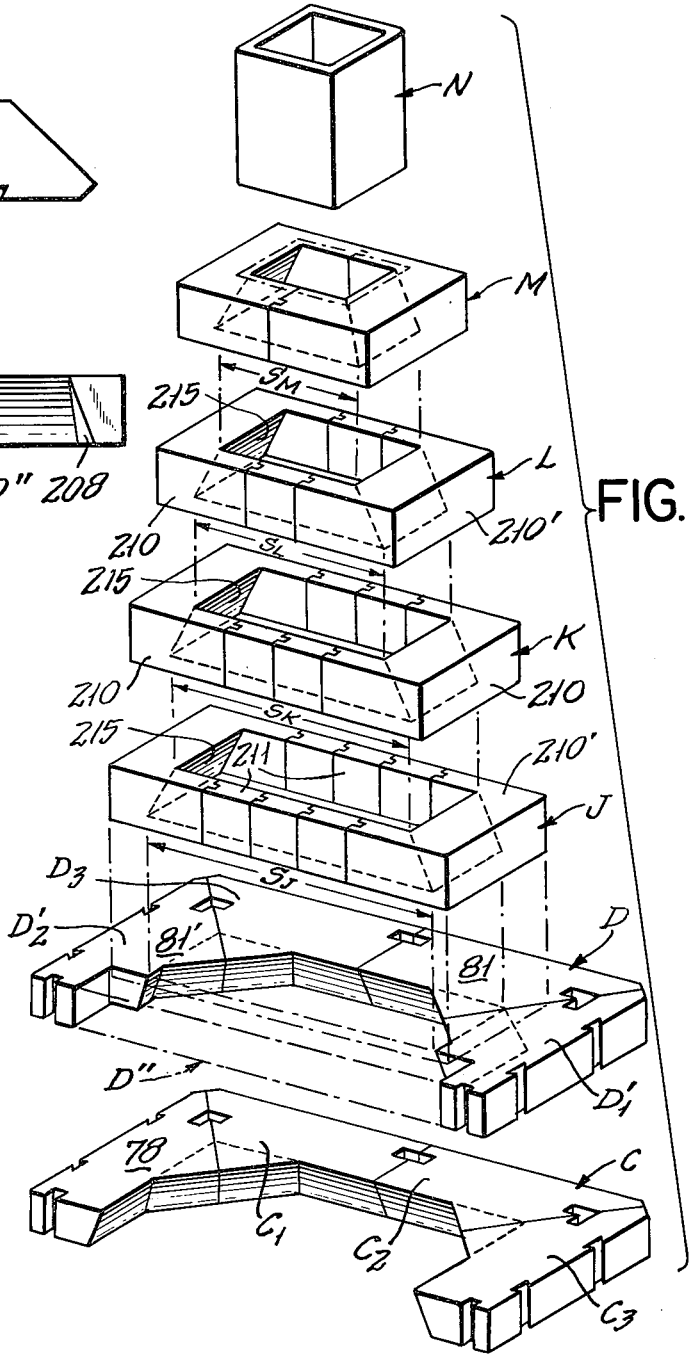
FIG. 26.

FIREPLACE CONSTRUCTION

RELATED CASE

This application is a continuation-in-part of copending application, Ser. No. 359,058, filed Mar. 17, 1982.

BACKGROUND OF THE INVENTION

The invention relates to a fireplace construction, as for application to a residential dwelling.

One of the best fireplaces, to keep warm with minimum consumption of wood fuel, was developed hundreds of years ago, after countless generations of heating with wood. It is still in use today in many of the colder countries of Europe and is aptly known as the Russian Fireplace. The Russian Fireplace is designed around two basic principles: burn the fire hot and fast, and channel the hot flue gases through a mass of masonry designed to absorb the heat. Fire is a conversion process to change into heat the stored energy in the fuel (wood). The hotter the fire, up to about 1200° F., the more efficient this conversion process becomes, and the more stored energy is converted into heat. When the hot flue gases are then channeled through several tons of masonry, through properly-designed flue passages, most of this heat can be absorbed and stored by the masonry. The stored heat will then be radiated into adjacent living space over a period of many hours.

If the Russian Fireplace has been in use so long and is so efficient, why then have its principles not been followed in designing today's fireplaces? And why have we been allowing up to 90 percent of the heat available in wood to be lost via the chimney? The answer is that fuel costs have been relatively cheap, and there has been massive reliance on fuels such as oil which have only recently skyrocketed in price. Stoves have emerged as means of more efficiently using available heat from a wood fire, but the process involves a fully enclosed hearth, so that a bright, cheery fire cannot be viewed.

BRIEF STATEMENT OF THE INVENTION

It is an object to provide an improved fireplace construction having an open or viewable hearth and providing materially enhanced efficiency of conversion of wood energy into useful heat.

It is a specific object to meet the above object in a construction which not only radiates heat directly from a fire and into adjacent living space but also collects and stores most of the remaining heat of combustion, for more sustained additional heat delivery into the living space.

Another specific object is to meet the above objects with improved means of drawing upon collected and stored heat as needed by surrounding living space requirements.

A further specific object is to meet the above objects with a modular system of blocks of refractory material.

A general object is to meet the above objects with a fireplace construction that is inherently safe, relatively inexpensive and simple to install, and which will provide extended freedom from the dangers of creosote build-up and chimney fire.

The invention achieves the foregoing objects and provides further features in a system of prismatic blocks, wherein the blocks are modular and are laid upon a base or hearth, as a stacked plurality of courses, to define a firebox region of laterally opposite side walls with a rear wall contiguously connected to the side walls. The blocks are characterized by external horizontal channel formations and by limited vertically extending end passages such that one or more vertically serpentine continuous air-flow ducts are established through successive horizontal channels in the stacked plurality of course in the walls. Above the firebox region, and surrounding an associated chimney region, the wall-block courses continue, providing extension of the air-flow duct system into additional heat-exchanging relation with the chimney. The chimney-flue system also relies on modular blocks with vertical flue passages which register from one to the next course, the arrangement being such as (1) to provide relatively large flue-surface area for extraction of flue-gas heat and (2) to cause plural cycles of horizontal undulation of the vertical flow of exhausted flue gases, in their upward passage through the chimney.

DETAILED DESCRIPTION

The invention will be illustratively described in detail and for a preferred embodiment, in conjunction with the accompanying drawings, in which:

FIG. 1 is an isometric view of a stacked plurality of modular blocks to define the heart of a fireplace of the invention;

FIGS. 2, 3 and 4, respectively, are front, side and plan views of the fireplace of FIG. 1 integrated with and located between an associated base and chimney;

FIGS. 5, 6 and 7, respectively, are sectional views, taken at 5—5, 6—6, and 7—7 in FIG. 4;

Figure 1:
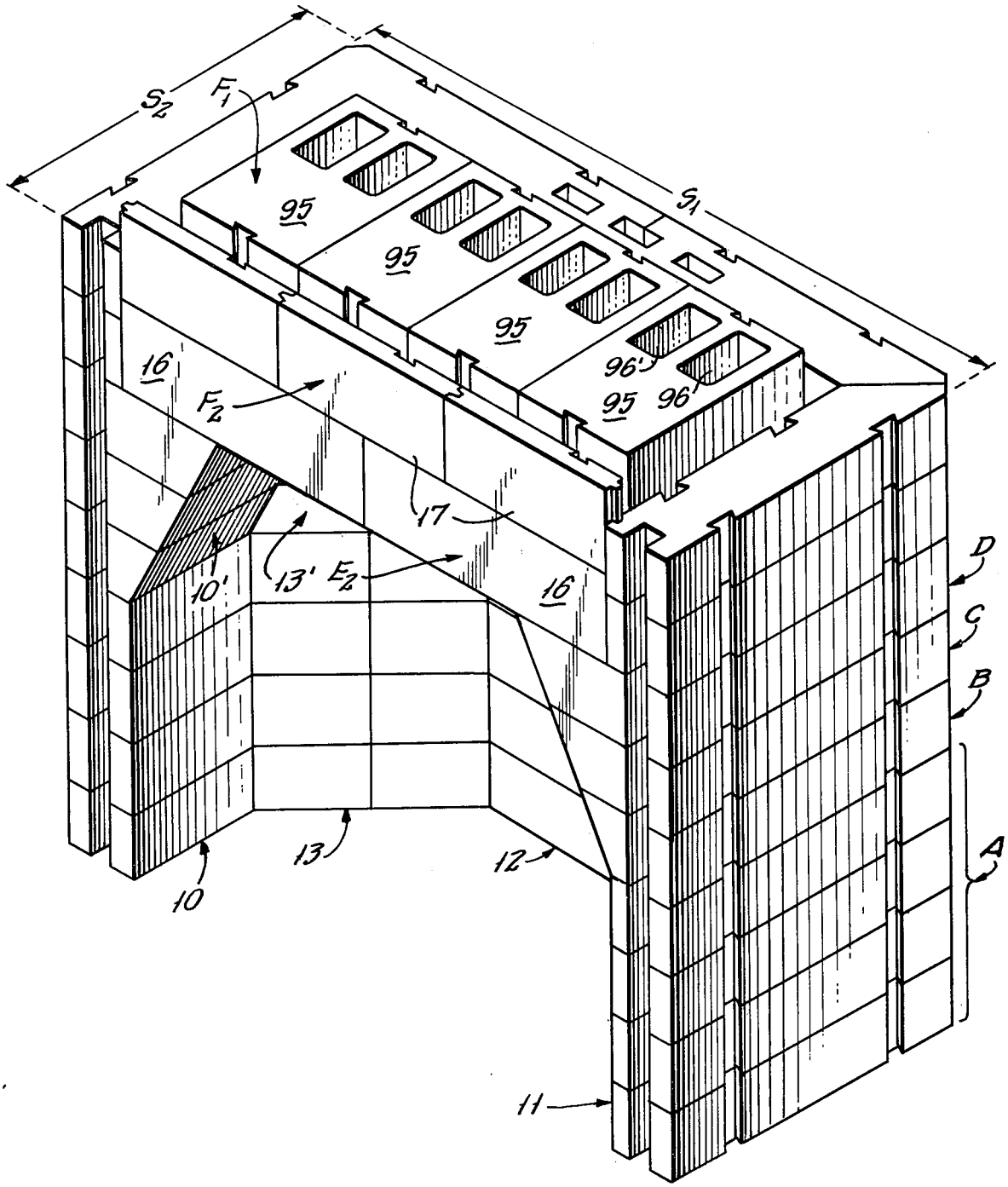
Figure 4:
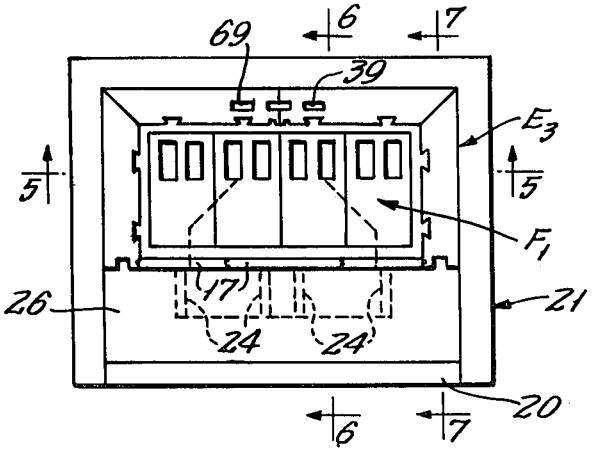
Figure 2:
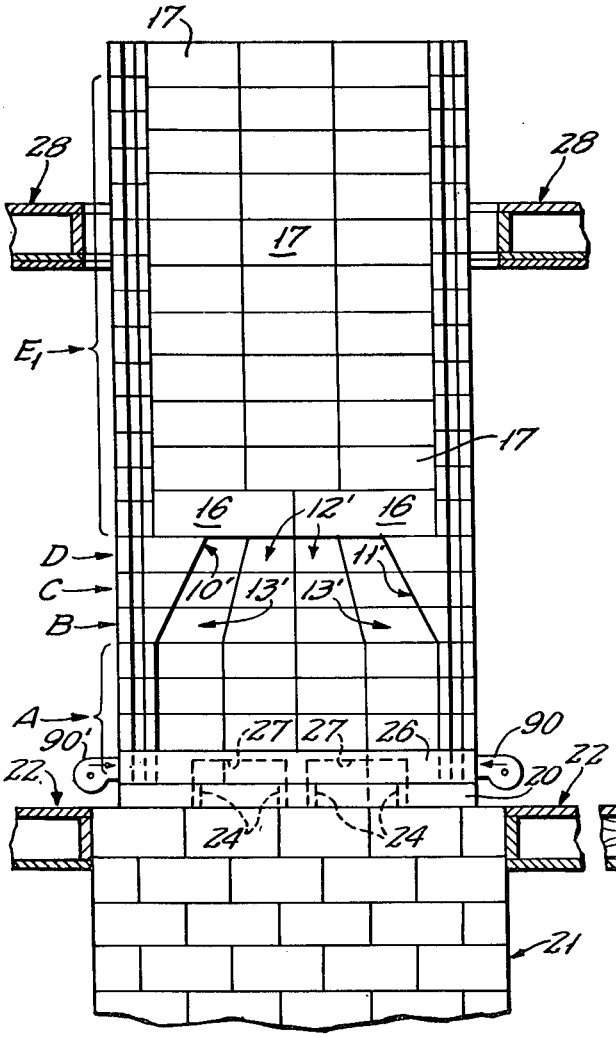
Figure 3:
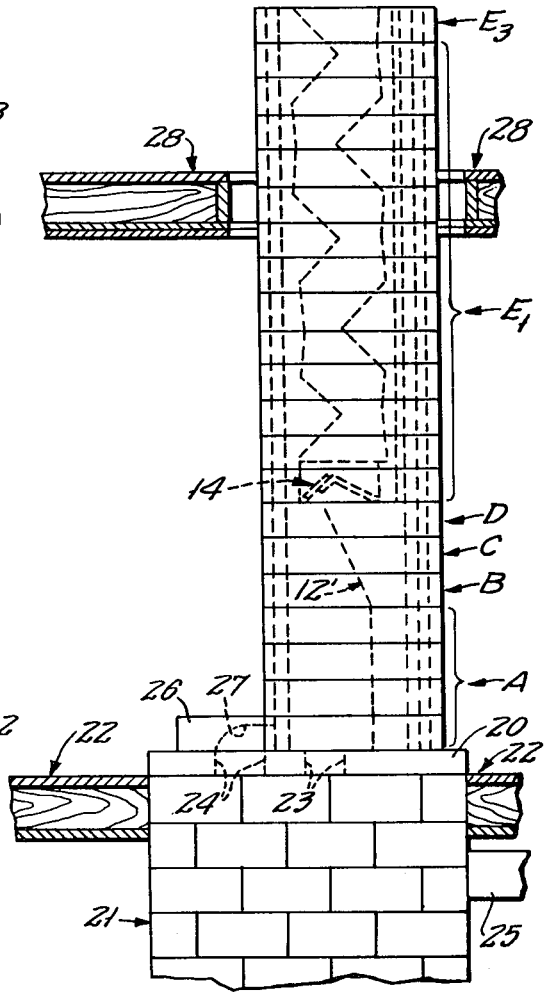
Figure 9:
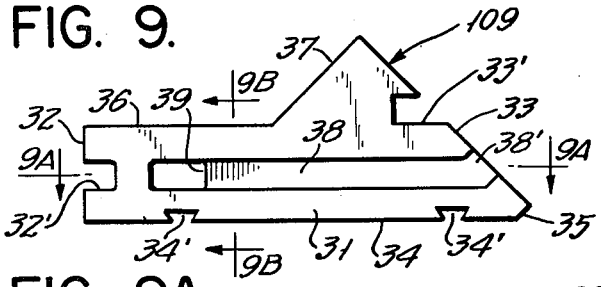
Figure 9B:
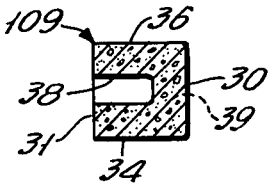
Figure 9A:
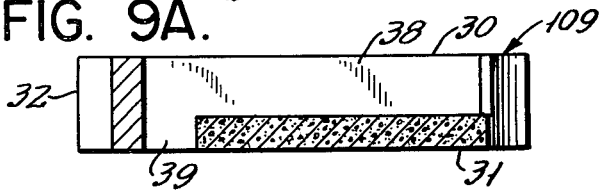
Figure 10:
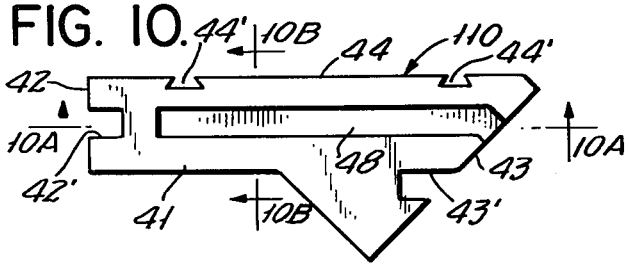
Figure 10B:
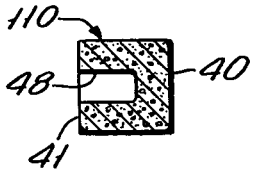
Figure 10A:
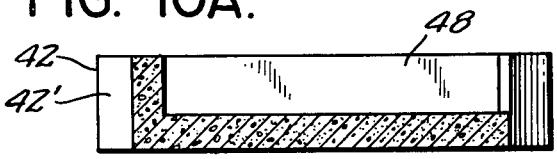
Figure 20:
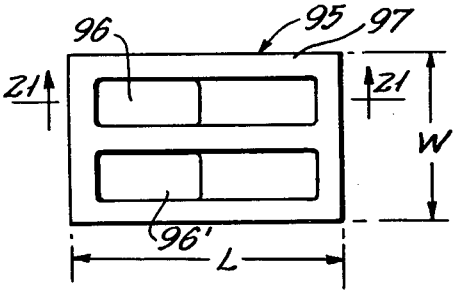
Figure 11:
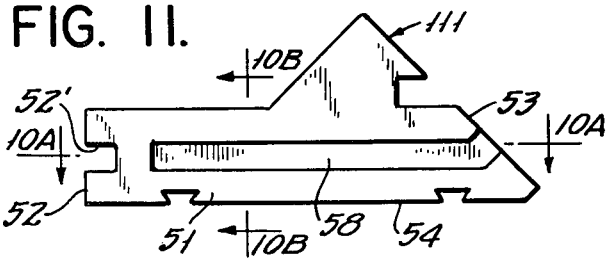
Figure 21:
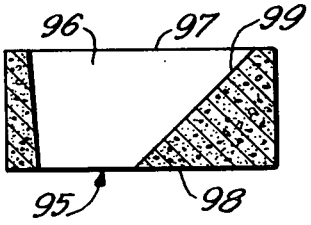
Figure 12:
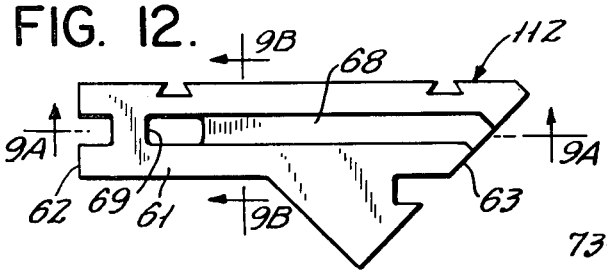
Figure 9C:
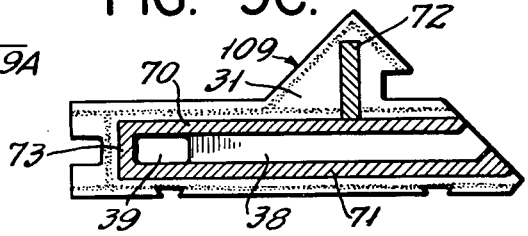
Figure 14:
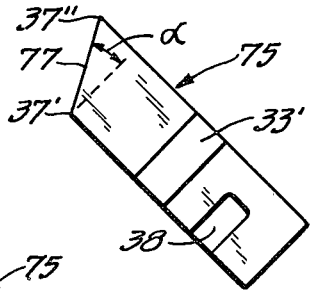
Figure 13:
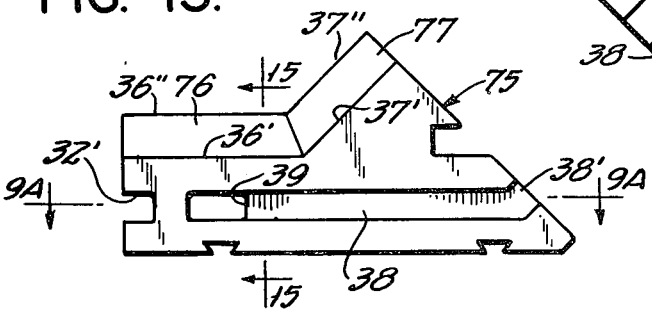
Figure 15:
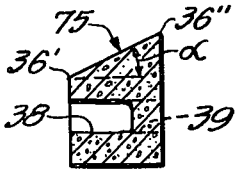
Figure 16:
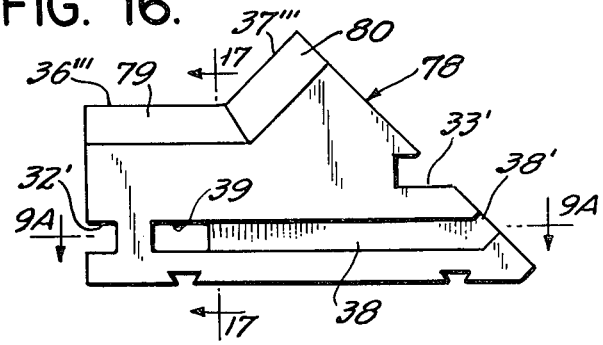
Figure 17:
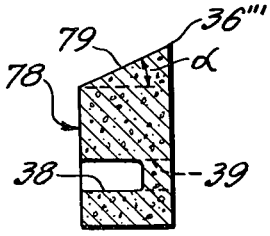
Figure 18:
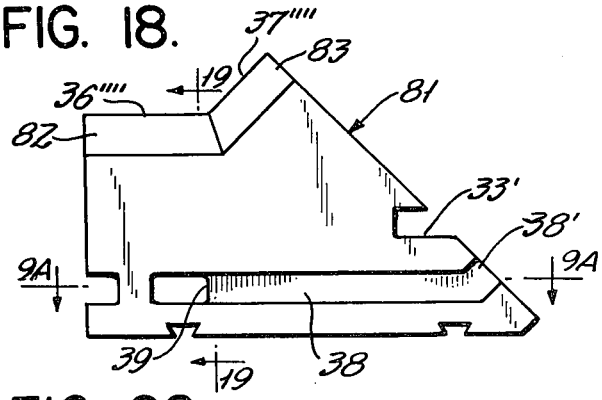
Figure 19:
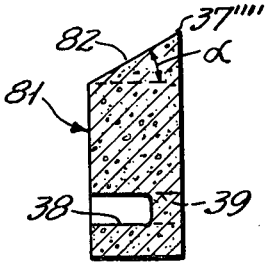
Figure 22:
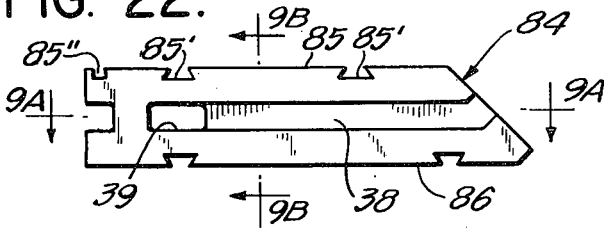
Figure 23:
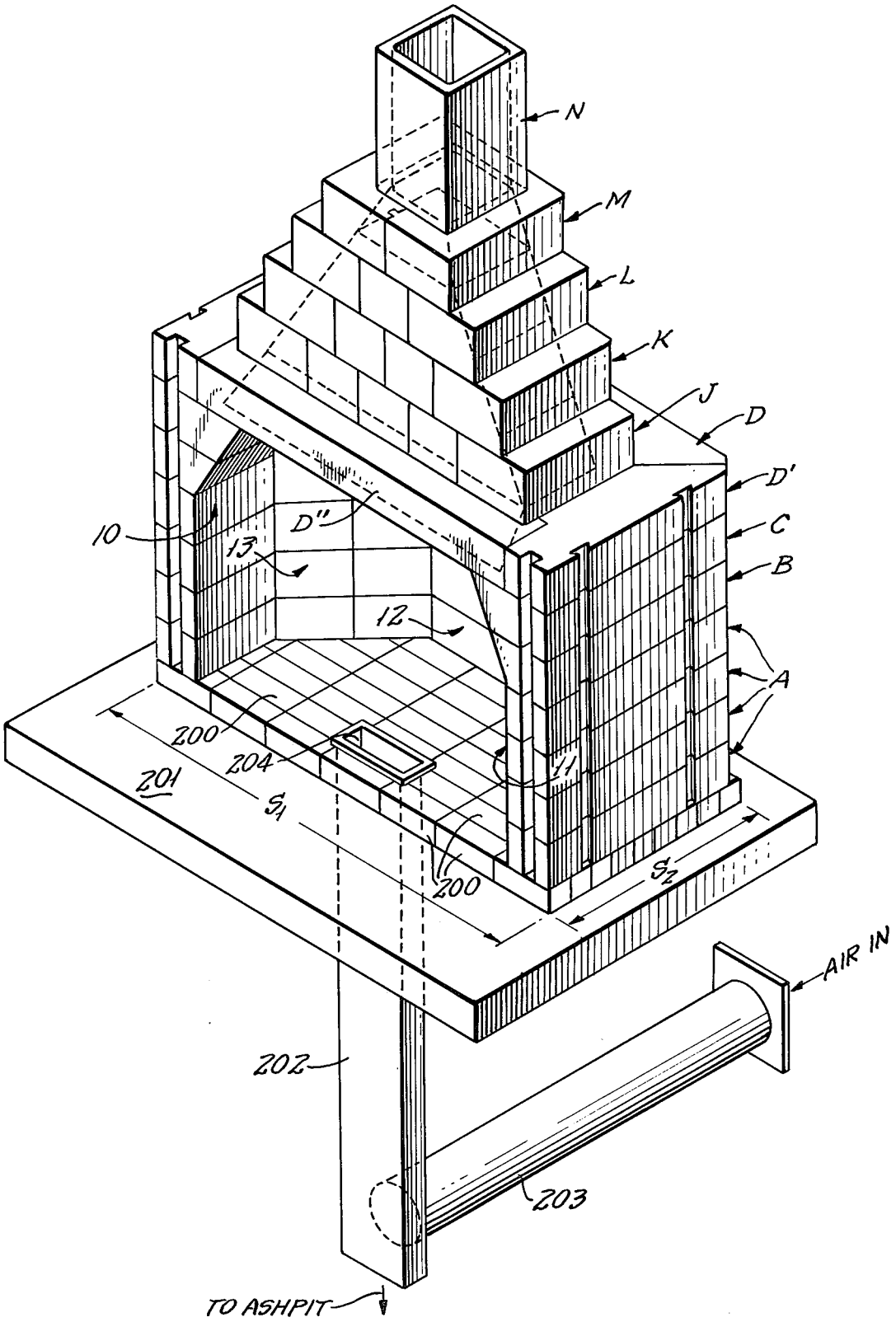
Figure 27:
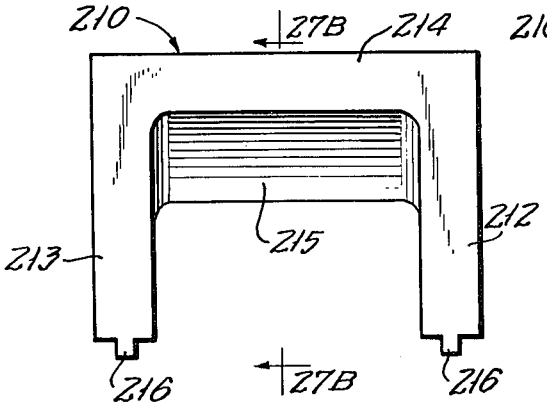
Figure 27B:
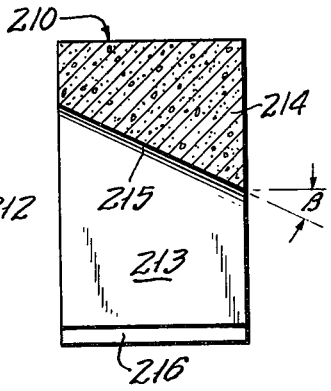
Figure 28:
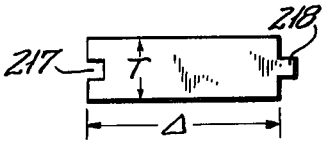
Figure 28A:
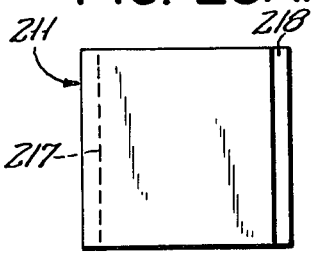
Figure 27A:
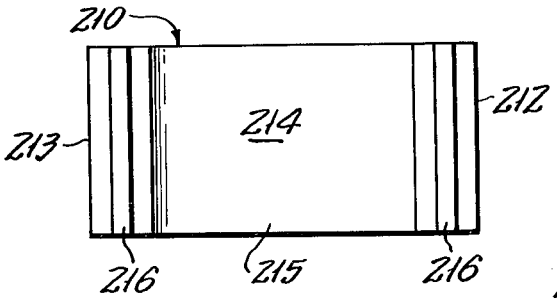
Figure 29:
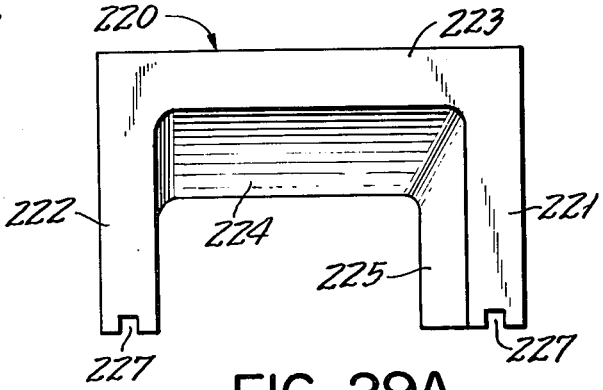
Figure 27C:
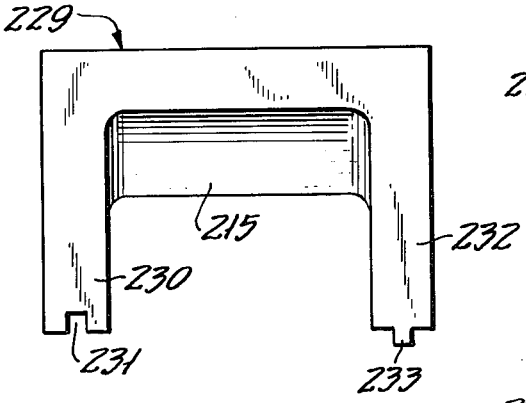
Figure 29A:
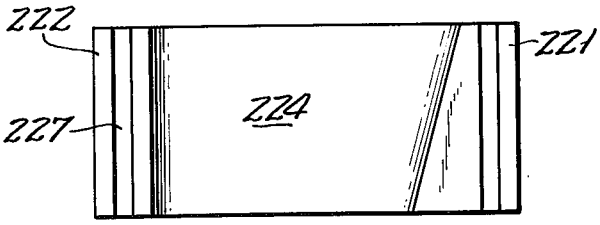
Figure 29B:
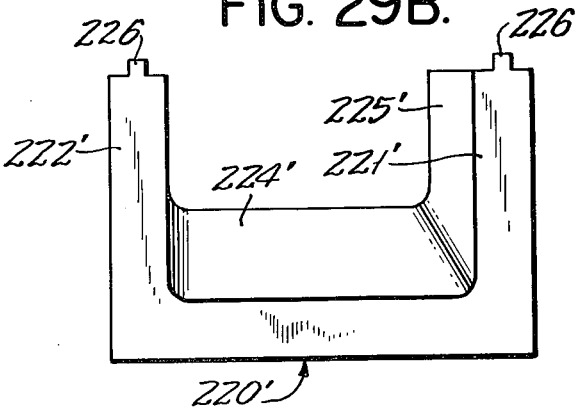

FIGS. 9, 9A and 9B apply to one of four modular blocks in a first course of the fireplace of FIG. 1, being respectively a bottom view, and sectional views taken at 9A—9A and 9B—9B in FIG. 9;

FIG. 9C is a repeat of FIG. 9, in order further to illustrate a sealing step in laying modular blocks;

FIGS. 10, 10A and 10B apply to another of the four modular blocks in said first course, being respectively a bottom view, and sectional views taken at 10A—10A and at 10B—10B in FIG. 10;

FIG. 11 applies to a third of the four modular blocks in said first course, being a bottom view, with indication of cross-sections as depicted in FIGS. 10A and 10B;

FIG. 12 applies to the remaining modular block in said first course, being a bottom view with indication of cross-sections as depicted in FIGS. 9A and 9B;

FIGS. 13, 14 and 15 apply to a modular block in the style of FIG. 9 but in a first course of wall convergence toward the upper end of the fireplace of FIG. 1, being respectively a bottom view, a slant-projection end view, and a sectional view taken at 15—15 in FIG. 13, and with indication of cross-section as depicted in FIG. 9A;

FIGS. 16 and 17 apply to a modular block in the style of FIGS. 9 and 13 but in a second course of said wall convergence, being respectively a bottom view and a sectional view taken at 17—17 in FIG. 16, and with indication of a cross-section as depicted in FIG. 9A;

FIGS. 18 and 19 apply to a modular block in the style of FIGS. 9, 13 and 16 but in a third course of said wall convergence, being respectively a bottom view and a sectional view taken at 19—19 in FIG. 18, and with indication of a cross-section as depicted in FIG. 9A;

FIGS. 20 and 21 apply to a modular flue block contained within the chimney region of the structure of FIGS. 2 to 4, being respectively a plan view and a sectional view taken at 21—21 in FIG. 20;

FIG. 22 applies to a modular block in the wall of the chimney region of FIGS. 2 to 4, being a bottom view in the style of FIGS. 9, 13, 16 and 18, and with indication of a cross-section as depicted in FIG. 9A;

FIG. 23 is a view similar to FIG. 1 to show a modification;

FIG. 24 is a view similar to FIG. 18 to show a corresponding structure used in the modification of FIG. 23;

FIGS. 25, 25A and 25B apply to a single lintel block used in the modification of FIG. 23, being respectively a perspective view, a rear elevation, and a sectional view taken at 25B—25B in FIG. 25;

FIG. 26 is a vertically exploded isometric view of successive adjacent course of modular blocks in the transistion between fireplace and chimney regions of FIG. 23;

FIGS. 27, 27A and 27B apply to a modular end block in transition courses of FIG. 23, being respectively a bottom view, an inside elevation, and a sectional view taken at 27B—27B of FIG. 27;

FIG. 27C is a view similar to FIG. 27, to show an alternative;

FIGS. 28 and 28A apply to modular connecting blocks in transition courses of FIG. 23, being respectively a plan view and a side elevation; and FIGS. 29 and 29A, respectively, correspond to FIGS. 27 and 27A, in specific context of the uppermost transition course of FIG. 23, while FIG. 29B is a view similar to FIG. 29, to show the block for mating with the block of FIG. 29.

It is convenient to begin with a general description in the context of the heart of the invention, namely the built-up modular fireplace of FIG. 1, wherein successive horizontal courses of modular blocks are identified for the different styles A, B, C, D, E and F involved. Basically, the built structure is of overall width span $S_1$ which is substantially twice its depth span $S_2$; these dimensions may be about 60 inches and about 30 inches in the illustrative case which is being described. The fireplace is open at the front between sidewalls 10-11, and a rear wall 12 connects sidewalls 10-11 via 45-degree inside-corner walls 13. The walls 10-11-12-13 extend vertically for four courses of A-style modular blocks, before the firebox surfaces of all four of these walls begin to converge; such convergent regions, as can be seen in FIG. 1, are generally identified 10'-11'-13'. The open front of the fireplace terminates at a course $E_2$ of modular lintel blocks 16, following three successive convergent-wall courses B-C-D.

The lintel course $E_2$ closes one of the four walls of outer chimney structure, denoted by outer three-wall courses $E_1$. At the level of lintel course $E_2$, a damper 14 (not shown in FIG. 1, but schematically indicated in FIG. 6) is operative as to flue gases funneled via the convergent-wall courses B-C-D; and above the level of the lintel course, successive courses $F_1$ of modular flue blocks channel the flue gases in their upward passage within the chimney, while the front wall of the chimney is closed by courses $F_2$ of keyed flat slabs 17. Suitable cementatious material (not shown) continuously fills spaces between blocks of each course, the rectangular annulus between the flue blocks $F_1$ and the chimney-wall blocks $E_1$ (and $E_2$, $F_2$) being additionally reinforced by embedded foraminous sheet metal; the latter may be expanded metal lath formed to the rectangular shape suggested at 18 in FIG. 1 and extending continuously for the full height of the chimney.

As a feature of the invention, the modular blocks of successive courses which define the outer confines of the fireplace and the chimney are formed with grooves and passages which cooperate to define continuous upwardly serpentine conduits for one or more flows of living-space air, extracting fireplace and chimney heat as may have been stored therein. The modular blocks to accomplish this result will be described in connection with FIGS. 9 to 22, but reference will first be made to FIGS. 2 to 4 and then to FIGS. 5 to 7 for an overview of the completed structure, i.e., structure sufficiently complete to receive a finish of decorative brick, paneling, plaster, or the like, as may be desired for appearance in the living space.

In FIGS. 2 to 4, the fireplace components of FIG. 1 will be recognized from the course designations A-B-C-D. The first of the A-style courses is laid upon a rectangular concrete base 20 which caps the upper course of four cement-block walls of an ash pit 21, which may be built on a basement slab and extend through an opening in first-floor joists and flooring 22. A central opening 23 in the hearth region of base 20 will be understood to be trap-door fitted, for periodic discharge of ash from the fireplace to the ash pit 21, and two laterally spaced openings 24 in front of the hearth region of base 20 allow outside air, entering the ash pit via a suitable duct 25, to become available in aid of fireplace action. As shown, a precast further cap 26 spans the front of the hearth region and, at coverage of openings 24, cap 26 is formed with curved recesses 27 whereby inlet fresh air from openings 24 is directed into what is in effect a slightly sunken hearth region. A basement access door (not shown) will be understood to provide access to pit 21 for periodic removal and disposal of accumulated ash.

The chimney courses $E_1$ are seen in FIGS. 2 to 4 to extend through a roughed-out opening in second-floor joists and flooring 28, to enable heated fresh-air servicing of both the first and second floors. It will be understood that, if desired, the chimney courses $E_1$ may similarly extend into further levels of living space, as for example into a finished attic space, and that the $E_1$ courses will end at the point beyond which living space heating is no longer desired. Beyond such point, a course $E_3$ of flat ungrooved blocks caps the serpentine air passages in the chimney walls and conventional flue-conduit connection (not shown) is made to the uppermost course $F_1$ of flue blocks, for through-the-roof exhaust porting of flue gases.

Figure 6:
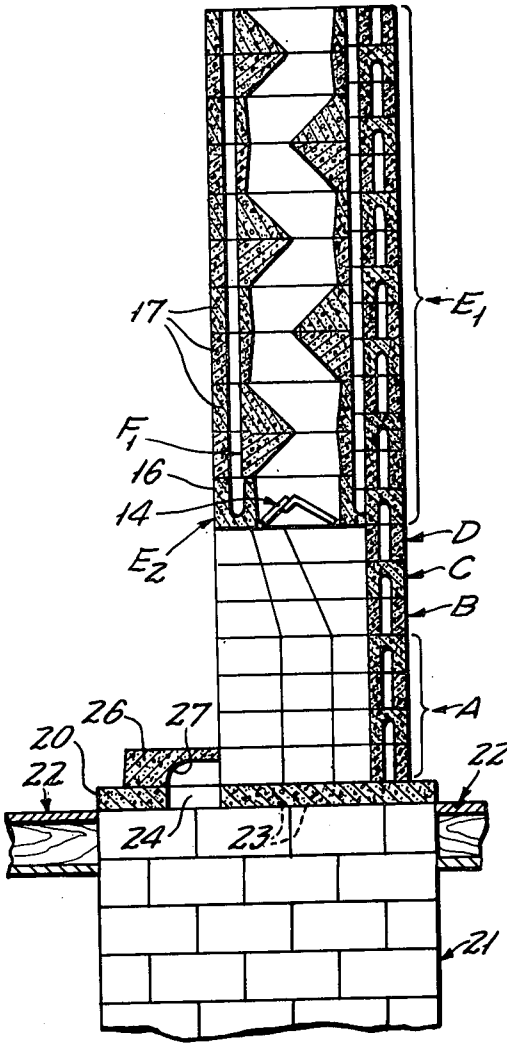
Figure 5:
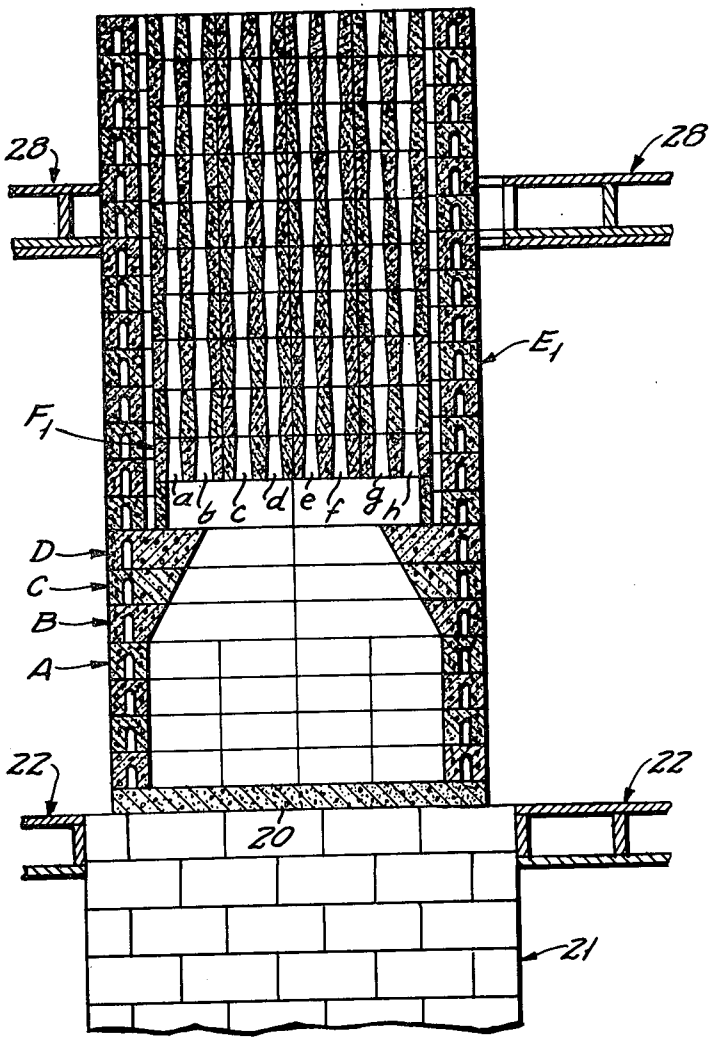

In the sectional views of FIGS. 5 and 6, interconnecting passages of the various courses $F_1$ of flue blocks are seen to establish plural flues a, b, c . . . h extending the full height of the heat-exchange air-duct courses $E_1$ of the chimney. And in the sectional views of FIGS. 5, 6 and 7, interconnecting passages and grooves of the various courses of all outer-wall blocks of courses A, B, C, D and $E_1$ are seen to establish the vertically serpentine conduit system for heat-exchange flow of fresh air.

Figures 8, 8A:
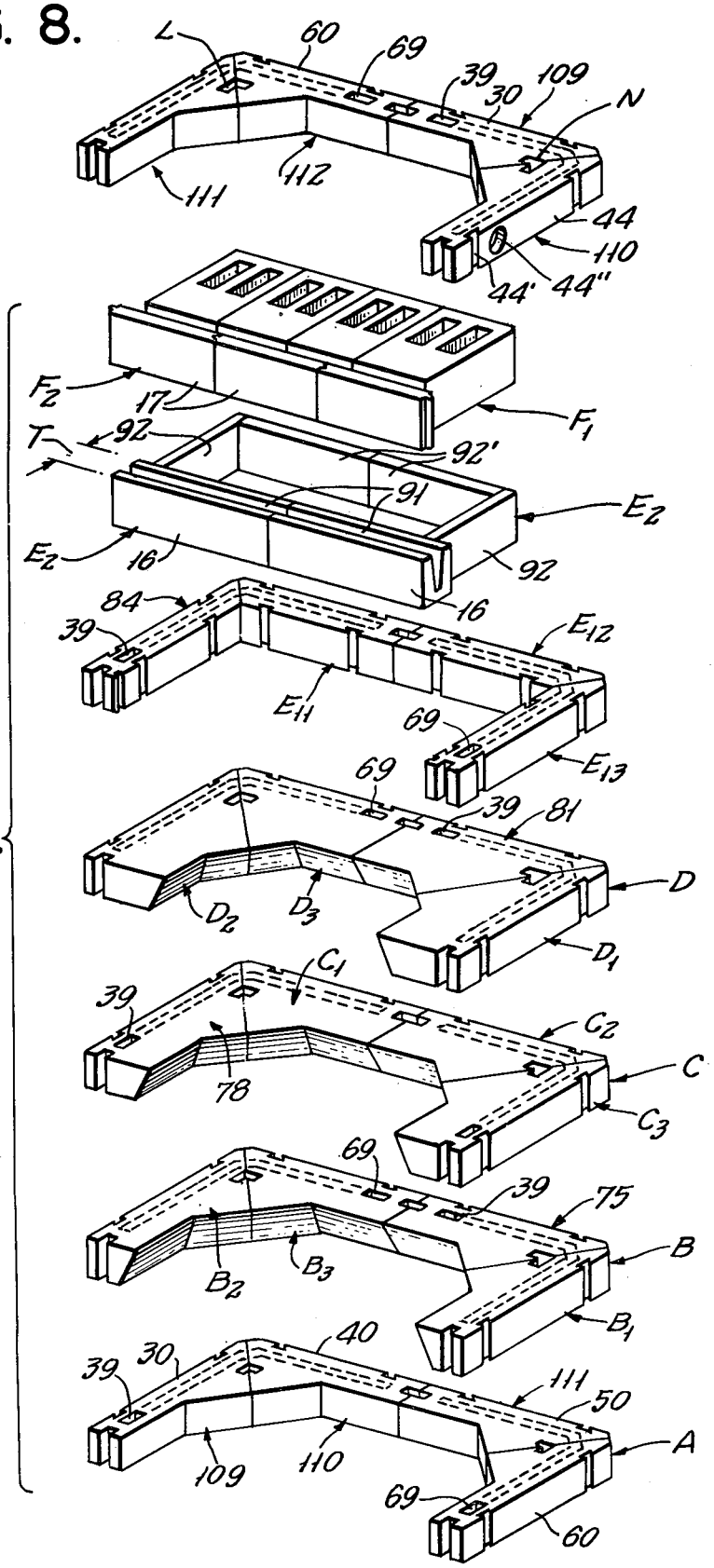
FIG. 8 is an isometric view to show the lowermost course of modular blocks in the fireplace of FIG. 1.
FIG. 8A is a vertically exploded isometric view of successive adjacent courses of modular blocks in the fireplace and chimney regions of FIGS. 2 to 4.

With primary attention directed to remaining figures of the drawings, the building of successive courses of modular blocks will now be described, beginning with the first A-style course, as to which the four blocks 109-110-111-112 of FIGS. 9 to 12 are specifically applicable, to develop a course layout as shown in FIG. 8. These four blocks are of identical horizontal planiform;

they differ only as to horizontal channeling and vertical through-passage involvement. They are shown in FIGS. 1 to 12 for their bottom view because they are conveniently molded upside down, preferably of refractory concrete which incorporates light-weight aggregate such as the sintered product of crushed shale, clay or slate.

The block 109 (FIGS. 9, 9A, 9B) is shown as an elongate prismatic body having parallel upper and lower horizontal surfaces 30–31, and vertical end surfaces 32–33, one (32) of which is perpendicular to the longitudinal sense of the block, and the other (33) of which is miter-sloped. The vertical side wall 34 which ultimately forms part of the outer-exposed wall surface of the structure of FIG. 1 extends longitudinally in a single plane from end surface 32 to substantial juncture with the miter-sloped end surface 33; in view of the acute-angle relation between side wall surface 34 and end surface 33 (shown to be a 45-degree relation), the otherwise sharp corner of intersection between surfaces 33–34 is preferably blunted, as by a truncation 35 perpendicular to the miter slope. The other vertical side wall is characterized by a first longitudinal portion 36 which is parallel to side wall 34, and by a second longitudinal portion 37 which diverges from portion 36 in a vertical plane, perpendicular to the miter slope. The lower horizontal surface is characterized by an elongate channel 38 which is open at the end surface 33 and which terminates near but offset from the other end surface 32; at its latter end, channel 38 communicates with a vertical through-passage 39 which is locally open at each of the horizontal surfaces 30–31.

Finally, block 109 is characterized by vertically continuous locking grooves 32′–33′ in each of the respective end surfaces 32–33 and at offset from channel 38 and passage 39; and longitudinally spaced vertically continuous locking grooves 34′ of dovetail section characterize the outer side wall surface 34. Preferably, locking groove 33′ has its primary directional sense parallel to the longitudinal sense of side wall 34, and at its opening to the mitered surface 33 the channel 38 includes a short angular offset 38′ that is shown perpendicular to the miter slope.

As noted above, the remaining blocks 110-111-112 of each A-style course are very much like block 109. For this reason, only their differences need be described. As seen from FIGS. 10, 10A and 10B, the block 110 presents a bottom view (FIG. 10) which is the mirror image of the bottom view (FIG. 9) of block 109. It has parallel upper and lower horizontal surfaces 40–41, the lower one (41) of which has a longitudinal channel 48 which is open at a mitered vertical end surface 43 and which terminates short of the other longitudinal-end surface; as further distinguished from block 109, block 110 has no vertical through-passage. The remaining features of block 110 are external, being longitudinal-end locking grooves 42′–43′, and outer-wall dovetail locking grooves 44′ which are spaced and located along outer wall 44 to correspond and register with grooves 34′ of block 109, as will become clear.

Block 111 (FIG. 11) is the mirror image of block 110 (FIG. 10) in every respect, being without any vertical through-passage as described at 39 for block 109. Thus, in block 11, the longitudinal channel 58 in lower horizontal surface 51 has an end opening only at the mitered longitudinal end 53. Except for the mirror-image relationship, locking grooves of block 111 are as described for block 110, so that the sectional views of FIGS. 10A and 10B are applicable to corresponding sections of block 111, as indicated by legend in FIG. 11.

Block 112 (FIG. 12) is the mirror image of block 109 (FIG. 9) in every respect, being characterized by a vertical through-passage 69 at the longitudinal end of the horizontal channel 68 which is open at the miter-sloped end surface 63. Except for the mirror-image relationship, locking grooves of block 112 are as described for block 109, so that the sectional views of FIGS. 9A and 9B are applicable to corresponding sections of block 112, as indicated by legend in FIG. 12.

The first A-style course, of blocks 109-110-111-112, is laid upon concrete base 20, in the pattern depicted in FIG. 8. In preparation for laying this first course, a circular side port is made through outer side wall 44 of block 110 to enable external duct connection to the longitudinally closed end of horizontal channel 48; such a port is depicted at 44″ in FIG. 8 close to but offset from the neary dovetail groove 44′, for example, on a horizontal center line contained in the plane 10B–10B of FIG. 10. In similar fashion another such port (not visible in FIG. 8) is made through the outer side wall 54 of block 111, as for example centered in the section plane 10B—10B of FIG. 11. In further preparation for block-laying, strips 70-71-72-73 of woven glass fiber or ceramic gasket material are adhered to the lower horizontal surface of each block, as illustrated for the case of surface 31 of block 109 (see FIG. 9C), the pattern being to sealingly surround edges of channel 38 and passage 39; and a bead of fire-clay mortar along outer edges of the gasket strips will assure temporary adhesion and sealed integrity of resulting air passages, as will become clear. The offset alignment of gasket strip 72 will be understood to provide assurance of horizontally parallel orientation of the individual blocks of progressively stacked courses.

Having thus prepared all blocks 109-110-111-112, the first A-style course is laid by applying block 111, inverted with respect to FIG. 11, with its gasketed lower surface directly against base 20. Block 112, similarly prepared with sealing material, including additional such sealing material vertically on the mitered wall 63, on both lateral sides of channel 38 opening thereto, is applied, inverted with respect to FIG. 12, with its gasketed lower surface directly against base 20 and with its mitered end surface 63 in sealed registration with the mitered end surface 53 of block 111. In similar fashion, the prepared block 109, inverted with respect to FIG. 9, is laid for abutment of its longitudinal end 32 in registration with the corresponding end 63 of block 112, followed by sealed similar application of the mitered end 43 of block 110 to the mitered end 33 of block 109, thus completing the first A-style course. It will be understood that in thus making this first A-style course, a first continuously sealed horizontal air duct will have been established between port 44″ (in block 110) to the vertical through-passage 39 which will be seen in FIG. 8 to be open at the upper horizontal surface 30 of block 109, and that a similar second continuously sealed horizontal air duct will have been established between the outer side wall port (described but not shown) in block 111 to the vertical through-passage 69 which is seen in FIG. 8 to be open at the upper horizontal surface 60 of block 112. And it will be noted that at abutting-block interfaces in the described first A-style course, vertically continuous locking voids are established for later filling with suitable cement or grout, at void alignments generally designated L-M-N.

In building the second A-style course upon the first A-style course, the block pattern shown for the A-style course of FIG. 8A is followed, but there is no further step of porting any side walls, in the manner described at 44" for the first course. Thus, in the second course, a seal-prepared and inverted block 109 is applied in vertical registration with block 111 of the first course, while second blocks 110-111-112 are similarly applied in vertical registration with the respective first-course blocks 112-109-110 of FIG. 8. Thus laid, the second A-style course establishes internal air-duct connection of first-course passage 38 to the connected horizontal channels 58–68 of second-course blocks 111–112, with upwardly open exposure of vertical passage 69 at the upper horizontal surface 60 of second-course block 112; in similar fashion, internal air-duct connection is established from exposed first-course vertical passage 69 to the connected horizontal channels 48–38 of second-course blocks 110–109, with upwardly open exposure of vertical passage 39 at the upper horizontal surface 30 of second-course block 109.

The third and fourth A-style courses are exact repeats of the described first two A-style courses, so that upon completed building of four courses, the first of two sealed air-duct systems will have gone through two full cycles of vertically upward serpentine horizontal coursing, involving connected first-course channels 48–38, passage-connection 39 to connected second-course channels 58–68, passage connection 69 to connected third-course channels 48–38, and passage-connection 39 to connected fourth-course channels 58–68. In similar fashion, the second of two sealed air-duct systems will have gone through two full cycles of vertically upward serpentine horizontal coursing, involving connected first-course channels 58–68, passage-connection 69 to connected second-course channels 48–38, passage-connection 39 to connected third-course channels 58–68, and passage connection 69 to connected fourth-course channels 48–38. At the upper horizontal surfaces 60–30 of the fourth course of blocks, the two serpentine air ducts will be upwardly open at 69 and 39, as shown for course A in FIG. 8A.

Thus far, all four courses have involved the same A-style planiform of block 109 (FIG. 9), with modification only to develop described mirror-image and closed/vertical-passage endings of the involved horizontal channels, the modifications being specifically shown and described in connection with blocks 110-111-112. In the further upward progression of courses, similar families of modular blocks are involved. Thus, for the B-style course which marks the beginning of firebox convergence, the block 75 (FIG. 13) will be understood to be illustrative of a family of four blocks having the planiform of block 75; and it will be further understood that, in the B-style course, block 75 has the horizontal-channel (38) and vertical-passage (39) configuration described for A-style block 109 (FIG. 9), and that three further blocks (not shown) of the B-style course have, respectively, the horizontal-channel (48) configuration of block 110 (FIG. 10), the horizontal-channel (58) configuration of block 111 (FIG. 11), and the horizontal-channel (68) and vertical-passage (69) configuration of block 112 (FIG. 12). These respective remaining B-style blocks are identified $B_1$-$B_2$-$B_3$ in FIG. 8*a*, so that the fifth course (B-style blocks) may provide the first half of the third cycle of serpentine air-duct coursing, ending with vertical openings of the respective air-duct systems at the upper surface of the course of B-style blocks.

The only difference between the B-style family of blocks and the A-style family of blocks resides in their firebox or inner wall surfaces, contributing to the convergent-wall slopes 10'-11'-12'-13' described in connection with FIGS. 1 and 2. In the case of block 75 (FIG. 13), this involves a first firebox wall surface 76, convergent inwardly from a lower edge 36' which registers with the plane of a strictly longitudinal firebox portion of an A-style block (e.g., portion 36 of block 109), to an upper edge 36"; and a second firebox wall surface 77, convergent inwardly from a lower edge 37' which registers the plane of a divergent longitudinal firebox portion of an A-style block (e.g., portion 37 of block 109). As seen in FIGS. 14 and 15, these inwardly convergent sloping firebox-wall surfaces have the same inward slope $\alpha$ from the vertical, $\alpha$, being suitably about 25 degrees.

The only difference between the C-style family of blocks and the B-style family of blocks is their greater inwardly projecting mass to enable continued building of the convergent-wall slopes of FIGS. 1 and 2. Thus, in FIG. 16, a C-style block 78 is typical and will be understood to have the horizontal-channel (38) and vertical through-passage (39) configuration of blocks 109 (FIG. 9) and 75 (FIG. 13). The C-style blocks are particularly characterized by inwardly convergent firebox-wall portions 79–80 of slope $\alpha$ from the vertical, beginning with lower edges which register with upper edges 36"–37" of B-style blocks and terminating at more inwardly offset upper edges 36'''–37'''.

In the C course of blocks depicted in FIG. 8A, the particular block 78 of FIG. 16 is seen to be laid in registration with A-style block 109 and with the B-style block $B_2$. In the succession of abutting C-family blocks, block $C_1$ is adjacent block 78 and will be understood to have the horizontal air-flow channel configuration (48) of A-style block 110 (FIG. 10), block $C_2$ is adjacent block $C_1$ and will be understood to have the horizontal air-flow channel configuration (58) of A-style block 111 (FIG. 11) and block $C_3$ is adjacent block $C_2$ and will be understood to have the horizontal air-flow channel (68) and vertical through-passage (69) configurations of A-style block 112 (FIG. 12). Thus, on completion of course C of laid-up blocks, the respective air flow systems are upwardly open at passages 39–69 at the end locations shown in FIG. 8A.

The only difference between the D-style family of blocks and the C-style family of blocks is their still greater inwardly projecting mass to enable continued building of the convergent-wall slopes of FIGS. 1 and 2. Thus, in FIG. 18, a D-style block 81 is typical and will be understood to have the hori- zontal-channel (38) and vertical through-passage (39) configuration of blocks 109 (FIG. 9), 75 (FIG. 13) and 78 (FIG. 16). The D-style blocks are particularly characterized by inwardly convergent firebox-wall portions 82–83 of slope $\alpha$ from the vertical, beginning with lower edges which register with upper edges 36'''–37''' of C-style blocks and terminating at most inwardly offset upper edges 36''''–37''''.

In the D course of blocks depicted in FIG. 8A, the particular block 81 of FIG. 18 is seen to be laid in registration with A-style block 111, with B-style block 75 and with C-style block $C_2$. In the succession of abutting D-family blocks, block $D_1$ is adjacent one end of block 78 and will be understood to have the horizontal air-flow channel configuration (48) of A-style block 110

(FIG. 10), while blocks $D_3$ and $D_2$ are successively adjacent the other end of block 81 and will be understood respectively to have the horizontal air-flow channel configurations (58) of A-style block 111 (FIG. 11), and the horizontal air-flow channel (68) and vertical through-passage (69) configurations of A-style block 112 (FIG. 12). Thus, on completion of course D of laid-up blocks, the respective air flow systems are upwardly open via passages 39–69 at the central rear locations shown in FIG. 8A.

At elevations above the D course of modular blocks, the respective serpentine air ducts within side and rear walls of the fireplace continue as chimney walls, involving a family of four wall blocks typified by block 84 of FIG. 22, having horizontal-channel (38) and vertical-passage (39) configurations which duplicate those of block 109 (FIG. 9). For each course $E_1$ of chimney wall blocks, each block of the family of four will be understood to have the planiform of block 84, being characterized by an inner side wall 85 which is parallel to its outer wall 86. The $E_1$-style blocks differ from each other in regard to air-duct characterizing features which, for the respective further blocks in the $E_1$ family, are identified as blocks $E_{11}$, $E_{12}$ and $E_{13}$, respectively corresponding (as to channel formations and through-passage formations) with the successive A-family blocks 110 (FIG. 10), 111 (FIG. 11) and 112 (FIG. 12). Finally, inner-wall surfaces (85) of chimney-wall blocks 84 are characterized by spaced vertical dovetail locking grooves 85' and by an end-mortise groove 85" for keyed engagement to end tenons of the flat blocks 17 of front-wall $F_2$ courses of chimney-wall completion.

Figure 7:
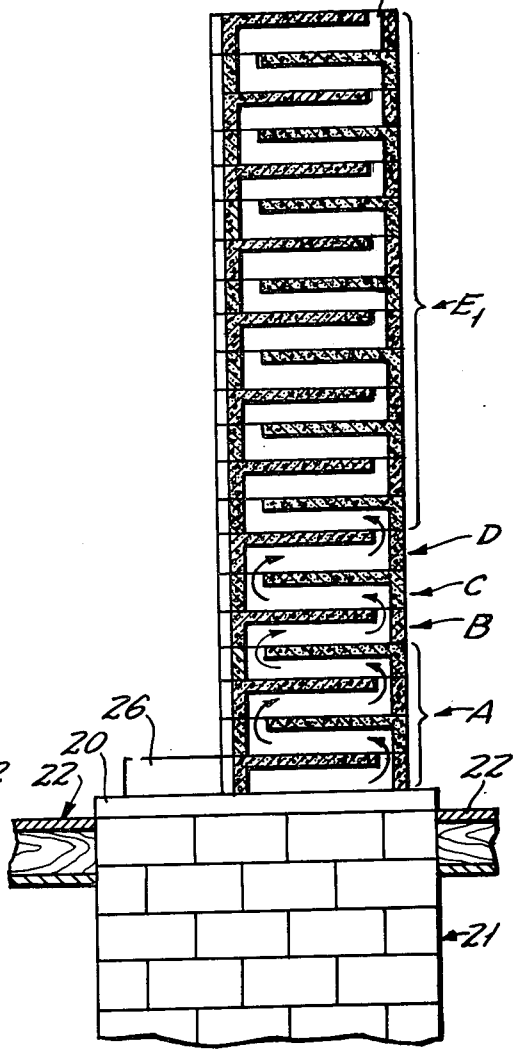

The upwardly serpentine connection of horizontal passages in successive course of all styles of outer-wall blocks is best apparent from the vertical sectional view of FIG. 7, wherein each of the successive styles of course blocks is identified by legends A, B, C, D, $E_1$, yet wherein the duct continuity progresses to an upper chimney course open port 39, for duct connection and warm-air distribution as appropriate or desired for the involved living space; a corresponding upper port 69 is presented at the top $E_1$ level, for the air-flow passage which courses the left side and the left half of the rear wall of the fireplace and its chimney wall. Alternatively, the top layer of chimney-wall blocks may be selected to fully close the air duct system, relying upon a suitably bored access to the wall-duct entry port 44" (FIG. 8). Further, it will be understood that to have described air flow in the duct system to be upward from the bottom is purely illustrative, as by relying on convection effects to achieve such flow. On the other hand, the described system also lends itself to air flow in the opposite direction, i.e., from top ports 39–69 to lower ports as at 44", in which case a blower system 90–90' (see FIG. 5) associated with the respective ducts may permit forced air flow for heat distribution in the direction, at the time, and at the flow rate currently needed for living-space accommodation.

Remaining undescribed modular structure pertains to lintel construction at $E_2$ (FIG. 1), chimney-wall closure at $F_2$ (FIG. 1) and flue construction via $F_1$ courses.

The lintel course at $E_2$ is shown to comprise but two elongate blocks 16, extending to and between side blocks of the chimney wall, at the first $E_1$ level thereof. Each lintel block 16 is seen in FIG. 7 to provide a deep upwardly open channel 91 between upstanding front and rear walls. The lintel blocks 16 derive their primary support from the upper surfaces of D-course blocks $D_1$–$D_2$, and flat upstanding slabs 92–92' rest on all D-course blocks to complete a box-like frame which will be understood to receive and locate a suitable damper assembly 14 (see FIGS. 3 and 6, but not shown in FIG. 8A). The box-like enclosure of lintel blocks 16 and slabs 92–92' is sized to provide peripherally continuous support of the involved peripheral-edge regions of the four modular chimney-flue blocks 92 which define the first course ($F_1$, in FIG. 8A) of the flue system; in providing such support, the top surface of the rear wall of the lintel blocks 16 will be understood to be in the same horizontal plane as the top surface of the adjacent framing succession of slabs 92–92'.

The same modular flue block 95 (FIGS. 20 and 21) serves all courses of flue construction. For the indicated illustrative overall width and depth spans $S_1$, $S_2$ of substantially 60 inches and 30 inches respectively, and for an $E_1$-style chimney-wall thickness T (see FIG. 22) of six inches, it is suitable to dimension the width W of each flue block at 11 inches, so that four such blocks 95 in side-by-side array (as shown for courses $F_1$ in FIG. 8A) account for a cummulative flue width span $S_3$ of 44 inches, leaving a two-inch gap between lateral chimney-wall blocks 84 ($E_1$-style) and adjacent lateral sides of the four-block array at each flue course $F_1$. Similarly, for a consistent lintel-block thickness T (see FIG. 8A) of six inches, it is suitable to dimension the length L of each flue block at about 18 inches, so that similar gaps may exist between the rear chimney-wall $E_1$-style blocks and the flue blocks, and between the front chimney-wall $F_2$-style slabs 17. These gaps are eventually filled with concrete as successive courses are laid, or after all flue courses and chimney-wall courses have been laid, and for reinforcement of the lintel span, it is preferred to embed an elongated reinforcing bar of steel in the cement within the lintel channel, such bar (not shown) being substantially the full span of the combined channel lengths of both lintel blocks 16.

Returning to FIGS. 20 and 21, each flue block 95 is seen overall to be rectangularly prismatic. Two like laterally spaced flue passages 96–96' extend vertically through block 95, beginning at one horizontal surface 97 with openings that span a maximum of the utilizable length L of the block, and converging from one of the longitudinal ends to reduced openings at the other horizontal surface 98; the convergence is at substantially 45 degrees along a uniform slope 99, so that at surface 98, the flue opening extends predominantly over only one half of the utilizable length of surface 98.

As best shown in FIGS. 3 and 6, the successive flue courses are preferably laid in registration of their openings in surfaces 97–98. Thus, for the first flue course $F_1$ (see also FIG. 1), each block 95 will be understood to be 180-degrees reversed from the orientation shown in FIG. 21, placing surface 97 (wide end of flue passages 96–96') in the lower horizontal plane of (a) flue block support on slabs 92–92' and (b) the rear wall of lintel blocks 16, and placing surface 98 (narrow end of flue passages 96–96') at a rearwardly offset location. In the second course of flue blocks, the surface 98 thereof is matched to the surface 98 of the first course (i.e., with matched narrow ends of flue passages 96–96' at the rearwardly offset location), while the surface 97 of the second course of flue blocks becomes the upper surface, with exposure of the long ends of its flue passages 96–96'. In the third course of flue blocks, the surface 97 thereof is matched to the surface 97 of the second course, and in the orientation such that the upper surface 98 of the third course exposes its narrow passage ends at a forwardly offset location (i.e., forwardly offset from their rearwardly offset location, at the interface between the first and second courses). In the fourth course, blocks 95 are oriented to register narrow openings at the described forwardly offset location, and to present surface 97 as the upper surface (with wide-end exposure of the flue passages 96–96'). For each successive four courses of flue-block assembly, the pattern repeats, so that the upward path of flue gases must undulate between the described forward and rearward offsets, and also so that the flue gases are subjected to recycling turbulence by reason of the substantially 2:1 change in flue cross-section which is necessarily involved twice for each four-course cycle of the described pattern of flue-course erection.

The described modular-block fireplace, chimney and flue construction will be seen to achieve all stated objects. All blocks are of cast refractory concrete, laid upon a refractory concrete base 20 which may be a 4-inch slab for the stated illustrative dimensions. For these illustrative dimensions, the wall blocks which have air ducts, namely, blocks of the A, B, C, D and $E_1$-style courses (and the fresh-air duct cap 26), may all have the same modular height of six inches, thus making a front opening of 48 inches width and 18 inches height, before convergence over the next 18 inches of courses B, C and D. This total opening may be closed by decorative framing of glass doors (not shown), so that beauty of the fire may be observed with total safety. The fire operates solely from inlet air drawn directly from outside the living space, so that combustion cannot deprive the living space of its already heated air. And it will be understood that, if desired, air drawn downward by pumps 90–90' may be taken at least in part from outside the living space, by provision of suitable means (not shown) for mixing of inside air and outside air in the supply connections to ports 39 and 69 at the upper end of the chimney wall.

It will be understood that in completing the described construction, all voids except for flue passages and heat-exchange air-duct passages will have been filled with suitable cementatious material, with total locking at all matching locking slots. This establishes an effectively monolithic structure, capable of great heat-storage capacity, so that air flow in the duct system can have a reservoir of heat upon which to draw as needed for heating the living space. It will be understood that the large-surface area and undulating nature for the flue-passage system contribute substantially to the ability to extract and store heat in the system, so as to reduce to a minimum the heat of flue gases discharged outdoors.

Upon completion of the described structure, aligned vertical dovetail locking grooves are exposed for the full vertical height of both end walls and the rear wall. These grooves facilitate erection of selected finish, be it brick or stone facing, plaster or paneling, as will be understood.

In the embodiment of FIGS. 23 to 29, it is again convenient to begin with a general description of the built-up structure (FIG. 23), wherein the fireplace proper is seen as a succession of four A-style courses of blocks already described, being shown laid upon floor blocks 200 set on a poured concrete slab 201, having a central opening for commercially available subfloor inlet-air ducting 202–203 which terminates in a flanged fixture 204, in place of one of the floor blocks 200. Above the A-style courses, the three next-succeeding courses B-C-D involve sloping inner surfaces which converge to narrow the flue entrance, and the convergence continues via a series of four further-converging courses J, K, L, M. The flue opening at the upper surface of course M happens to be shown generally square, but this opening will be understood to be of size and shape to directly serve standard flue tile such as that indicated for course N, which may be the lowermost one of a vertically stacked succession of like tile courses N. Convergence of inner walls which communicate with the flue course N is generally indicated by dashed lines in FIG. 23.

In contrast with FIG. 1, the open front of the fireplace of FIG. 23 terminates at course D, wherein specially formed side blocks D' have notched front inside edges so that a single lintel block D" can derive direct support from the front lateral blocks of course C. The back wall blocks of course D may be as described for FIG. 18; but the special side blocks (D') of this course conform to detail shown in FIG. 24, and detail for the lintel block is the subject of FIGS. 25, 25A and 25B.

Referring to FIG. 24, the special side blocks (D') are seen closely to match those for the D-style block 81 of FIG. 18; for this reason, the same numbers are shown with primed notation for corresponding elements of block 81' in FIG. 24. The only difference is that at its inside-front corner, block 81' is formed with a square cut-out or notch 205 whereby a square corner area of the top surface of each of the front blocks of course C is exposed for secure seating of the respective ends of the lintel block (D").

In FIGS. 25, 25A and 25B, the lintel block (D") is seen to be an elongate single rectangular prism, which may be of square section, and which has a sloping elongate inner-wall surface 206 extending for the unsupported span of block D", thereby defining a full top surface and a narrow bottom surface 207 adjacent the front vertical surface of the block. The narrow bottom surface 207 is thus seen to define a front lower lip, from which flue gases may be directed rearward to the generally trapezoidal opening defined at the upper surface of course D; see course D as shown in the exploded diagram of FIG. 26. The sloping inner surface 206 of the lintel block terminates at sloping end walls 208, for general conformance with adjacent inner wall surfaces of the front-side blocks $D_1'$–$D_2'$ of course D.

The successive further-convergent courses J, K, L, M utilize similar assemblies of basically two modular-block configurations. In course J, these two configurations are seen to comprise two U-shaped end blocks 210–210', and two groups of three connecting blocks 211. Detail for these two basic shapes will be explained in connection with FIGS. 27, 27A, 27B and FIGS. 28, 28A, respectively.

Block 210 is seen to be of generally U-shape, comprising arms 212–213 spaced by integral connection to a body section 214. In FIG. 27, the view is from the underside and at its lower surface the arms 212–213 and the body section 214 are seen to have substantially the same thickness. This thickness is constant for arms 212–213, but it expands in accordance with an inwardly sloping inner wall surface 215 of body section 214, the inward slope being at inclination $\beta$ to the vertical, as identified in FIG. 27B. The extremity of each arm 212–213 is characterized by a vertical rib formation 216, for interengaged relation to a corresponding vertical groove (217) in the adjacent connecting block 211. The other end block 210' will be understood to be of identical construction, except for vertical groove formations in place of the vertical ribs 216 of block 210.

All connecting blocks 211 are of identical construction, being rectangular prismatic and of thickness T to match the thickness of arms 212–213 in the end block of FIG. 27. The body of each block 211 is characterized by vertical groove 217 along one of its longitudinal ends, and by a vertical rib 218 along the other of its longitudinal ends. Course J is thus characterized by rib/groove engagement at each of eight adjacent vertical edges, of end-block to connecting-block connection, and of connecting-block to connecting-block engagement. The net result is a peripherally complete definition of one element of a progressively reducing inner rectangular enclosure, with reduction occurring via surfaces 215 of the end blocks. Preferably, the slope $\beta$ of end-wall convergence at course J is such as to have each surface 215 reduce the longitudinal span (of the inner rectangular enclosure) from a maximum $S_J$ at its lower surface, to a minimum $S_K$ at its upper surface, and the difference $\Delta$ between $S_J$ and $S_K$ is equal to the effective longitudinal dimension of the modular connecting block 211 (see FIG. 28).

Courses K and L meet precisely the description given for course J, except that in course K there are two connecting blocks 211 to complete the respective front and back walls of the decreasing rectangular enclosure, and in course L there is but one connecting block 211 to complete the respective front and back walls of the decreasing rectangular enclosure. The inner end walls 215 of course K reduce from a maximum span $S_K$ at the lower surface, to a minimum span $S_L$ at the upper surface; and the inner walls 215 of course L reduce from a maximum span $S_L$ at the lower surface, to a minimum span $S_M$ at the upper surface. In both cases, the reduction is again to the extent $\Delta$, thus assuring continuous definition of the convergent inner walls.

The uppermost convergent course M has no connecting-block walls and merely comprises interfitting end blocks which may be another pair as described for blocks 210–210', but which, for purposes of developing a substantially square opening for accommodation of square flue tile N, may incorporate an inwardly sloping surface of one or both arm elements of each block. As shown, the inner surface of each front arm 221–221' of two end blocks 220–220' is inwardly sloped, and the corresponding rear arms 222–222' are of uniform thickness. Thus, for end block 220, the inner surface 224 of its body section 223 corresponds with the slope and almost the extent of surface 215 of block 210, and the slope of the inner surface 225 of front arm 221 is as necessary to achieve the delivery-section area desired for the particular flue tile N. End block arms will be understood to terminate with interengageable vertical rib and groove formations 226–227 as previously described for rib 216 and groove 217.

The described provision of a rib 216 on each of the arms of block 210, and of a groove (217) on each of the arms of block 210', will be seen to be acceptable and preferable in the situation in which the two end blocks 210–210' are cast at the same time, as in a two-cavity mold. For the situation in which an economy is to be realized through a single-cavity mold to successively mold the respective end blocks (of courses J-K-L) one at a time, it is desirable to provide one arm with a rib formation, and the other arm with an engageable groove formation; such an arrangement is illustrated in FIG. 27C, wherein one arm 230 of end block 229 has a vertical groove 231 and the other arm 232 has a vertical rib 233. The modular connecting block 211 described in connection with FIGS. 28 and 28A remains useful in connection with the single shape of block 229 to serve both ends of each of the courses J-K-L.

While the invention has been described in detail for preferred embodiments, it will be understood that modifications may be made without departing from the claimed invention. For example, instead of requiring a family of four of the same style block to complete a given course (such as the block family 109-110-111-112, described for each of the A courses), the requirement for different blocks may be essentially cut in half by casting each block with a more shallow longitudinal groove in each of its upper and lower surfaces, such grooves being open to one longitudinal end of the block and extending to points close to but short of the other longitudinal end. This would make for families of two blocks per course, in that one block of the family would have a through-passage (as at 39) at the channel-closed end, and the other block of the family would have no through-passage. The air-duct passages would then in each case be defined by and between matching horizontal channels of adjacent courses, and vertical interconnection of one horizontal passage to the next would alternate from one to the other of the longitudinal ends of the abutted blocks of the family, with each upwardly indexed successive course, as will be understood.

The described fireplace of FIGS. 23 and 26 represents substantial simplification over the more efficient configuration of FIGS. 1 and 8A. Nevertheless, important recovery of firebox heat is available for the FIG. 23 arrangement, using upwardly serpentine passages as described in connection with FIG. 1, and providing entering and exit port connections (not shown) to such passages. Alternatively, where it is acceptable merely to store firebox heat in firebox walls and to rely on radiated release of stored heat from the firebox walls and into surrounding space, the passages and their serpentine connection can be omitted, as by making all component blocks solid, i.e., without passage-forming grooves and ports.

What is claimed is:

1. A fireplace construction, comprising a first stacked plurality of courses of modular prismatic blocks laid upon a base to define an open-fronted firebox region of opposed sidewalls and a rear wall contiguous thereto, lintel means spanning the open front at an upper course of said blocks and constituting with the blocks of said upper course the peripheral enclosure of a generally rectangular opening for upward conduct of firebox-exhaust products of combustion, said opening having an elongate dimension in the span direction of the lintel and a lesser dimension transverse to the elongate dimension; and a second stacked plurality of courses of modular blocks laid upon the lintel and upon upper-course blocks of said peripheral enclosure, the blocks of said second plurality comprising (1) U-shaped end blocks wherein an upstanding central body connects upstanding arms which are spaced to span substantially the transverse dimension of the opening, and (2) flat upstanding spacer blocks of thickness substantially matching the thickness of said arms, the inner-wall surface of the central body sloping from a relatively narrow lower surface of the body to a relatively wide upper surface of the body, and the width difference between said upper and lower surfaces of the body being substantially one half of the longitudinal extent of said spacer blocks; whereby the first course of the second stacked plurality may comprise one of said end blocks at each of the respective ends of the rectangular opening, with the arms of said end blocks extending toward each other in partial longitudinal register with longitudinal margins of the rectangular opening, and first like pluralities of spacer blocks in longitudinal end-to-end abutment with each other and with the respective arms of the two end blocks; and further whereby the second course of the second stacked plurality may be similarly constituted of opposed end blocks having their respective arms connected by end-to-end arrays of second like pluralities of spacer blocks, each second plurality comprising one less spacer block than each first plurality, so that the sloping inner-wall surfaces of the end blocks of the respective courses may conjointly define a single inwardly convergent surface.

2. The construction of claim 1, in which said end blocks and said spacer blocks have integrally formed tongue-and-groove interfit formations at their respective abutment regions.

3. The construction of claim 1, in which said end blocks have integrally formed tongue-and-groove interfit formations at the respective ends of the arms thereof so that the uppermost course of said second stacked plurality may comprise two end blocks alone, with their arms in interengaged abutment.

4. The construction of claim 3, in which the inner-wall surface of at least first abutted arms of said end blocks slope inwardly in the upward direction.

5. The construction of claim 1, in which said lintel means is another prismatic block of vertical height matching the course height of the blocks of said first stacked plurality.

6. The construction of claim 5, in which blocks defining opposed sidewalls of the upper course of said first stacked plurality are recessed at the forward end of the inner wall surface thereof, thereby exposing locally inner and forward regions of the upper surface of blocks of the next-adjacent lower course, said lintel means overlapping and deriving support from said exposed regions.

7. The construction of claim 5, in which the inner-wall surface of said lintel block slopes inwardly in the upward direction.

8. The construction of claim 1, in which at least each of the sidewalls blocks of the upper course of the first stacked plurality has an inner-wall surface which slopes inwardly in the upward direction.

9. The construction of claim 8, in which each of the sidewall blocks of the next-to-upper course of the first stacked plurality has an inner-wall surface which slopes inwardly in the upward direction, the inwardly and upwardly sloping surfaces of vertically adjacent sidewall blocks of the respective two upper courses being similarly inclined and defining conjointly a single inwardly and upwardly sloping surface.

10. The construction of claim 9, in which the inwardly and upwardly sloping surfaces of said vertically adjacent sidewall blocks define at least in part a substantially continuous surface with the inwardly and upwardly sloping surface of the vertically adjacent end blocks of the second stacked plurality of courses.

11. The construction of claim 1, in which all blocks of both stacked pluralities are solid castings of cementitious material.

12. The construction of claim 1, in which blocks of the first stacked plurality are characterized by horizontal surfaces having external horizontally extending channel formations which define a horizontal-air-duct portion by reason of first and second courses of first-plurality blocks being in stacked vertically adjacent array, one block of each horizontally adjacent pair of blocks in each of said vertically adjacent courses having near one to the exclusion of the other horizontal end thereof a vertically extending passage providing communication between the upper and lower horizontal surfaces thereof, the vertically extending passages of one of said vertically adjacent courses being at horizontal offset from the vertically extending passages of the vertically next-adjacent course, whereby one or more vertically serpentine continuous air-flow ducts are established through successive horizontal channels in the stacked plurality of courses of one or more of the walls of said first stacked plurality.

* * * * *